US007210677B2

(12) United States Patent
Fukumura et al.

(10) Patent No.: US 7,210,677 B2
(45) Date of Patent: May 1, 2007

(54) PAPER FEEDER AND IMAGE SCANNING DEVICE

(75) Inventors: Atsushi Fukumura, Kyoto (JP); Toshihiro Kawamura, Uji (JP); Hirokazu Inoue, Nagaokakyo (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 436 days.

(21) Appl. No.: 10/854,121

(22) Filed: May 26, 2004

(65) Prior Publication Data

US 2005/0035524 A1 Feb. 17, 2005

(30) Foreign Application Priority Data

Jul. 4, 2003 (JP) ..... 2003-192002
Jul. 15, 2003 (JP) ..... 2003-196944
Jul. 15, 2003 (JP) ..... 2003-196945

(51) Int. Cl.
*B65H 5/00* (2006.01)

(52) U.S. Cl. ..... 271/10.01; 271/10.09; 271/121

(58) Field of Classification Search ..... 271/10.01, 271/10.09, 10.11, 121, 124
See application file for complete search history.

(56) References Cited

U.S. PATENT DOCUMENTS 5,725,208 A * 3/1998 Miyauchi ..... 271/10.09
5,758,981 A * 6/1998 Lesniak et al. ..... 400/625
5,890,821 A * 4/1999 Lesniak et al. ..... 400/625
2001/0015519 A1* 8/2001 Kuo et al. ..... 271/10.11
2005/0051943 A1* 3/2005 Yamanaka et al. ..... 271/10.01

FOREIGN PATENT DOCUMENTS

| | | |
|---|---|---|
| JP | 11-091972 | 4/1999 |
| JP | 2001-022137 | 1/2001 |
| JP | 2001-348130 | 12/2001 |
| JP | 2002-255363 | 9/2002 |
| JP | 2003-031413 | 1/2003 |
| JP | 2005-022843 | 1/2005 |

* cited by examiner

*Primary Examiner*—David H. Bollinger
(74) *Attorney, Agent, or Firm*—Hogan & Hartson LLP

(57) ABSTRACT

A paper feeder includes a sheet supply unit that feeds sheets placed on a sheet placing part, a separating roller the separates the sheets fed by the sheet supply unit one sheet at a time and supplies each sheet to a sheet transportation path, a transportation roller that transports the sheets provided downstream of the separating roller and a link mechanism connected to the transportation roller via a transmitting unit. When the transportation roller rotates in a sheet transporting direction, the link mechanism swings so that a shutter opens the sheet transportation path and maintains an opened state. When the transportation roller rotates in a direction opposite to the sheet transporting direction, the link mechanism swings so that the shutter closes the sheet transportation path.

20 Claims, 11 Drawing Sheets

PAPER FEEDER AND IMAGE SCANNING DEVICE

BACKGROUND OF THE INVENTION

1. Field of the Invention

The present invention relates to a paper feeder, and more particularly to a paper feeder having a drive mechanism for a shutter for preventing an inappropriate operation of a user when placing a stack of sheets on a sheet placing part.

2. Description of the Related Art

In general, an electro-photographic copying machine or a facsimile machine includes an Automatic Document Feeder (ADF). The ADF feeds a stack of sheeted documents set on a document tray, separates the sheeted documents one sheet at a time and transports each sheet towards a scanner. The ADF includes a pick-up roller that feeds the sheeted documents set on the document tray, a separating unit that separates the fed documents one sheet at a time and supplies each sheet to a sheet transportation path, and a transportation roller that is disposed downstream of the separating unit and transports the document towards the scanner. Between the pick-up roller and the separating unit, a shutter that can open and close the sheet transportation path is provided on the sheet transportation path. The shutter prevents an inappropriate operation of a user when placing a stack of sheeted documents. For example, when the user sets a stack of sheeted documents on a sheet placing table, the shutter prevents a sheeted document from being forced between a separate roller and a friction pad that constitute the separating unit. Moreover, the shutter functions to align a leading edge of the sheeted documents.

The paper feeder having the shutter feeds the sheeted documents stacked on the document tray from an uppermost sheet by the pick-up roller. Further, the pick-up roller is provided rotatable on a tip of a pick-up arm that can be elevated and lowered vertically (with a fulcrum as the center). The shutter is controlled to be lowered in response to the elevating and lowering motion of the pick-up roller and to recede below the sheet transportation path. After feeding all of the documents set on the document tray, the shutter protrudes onto the sheet transportation path, and aligns and positions a leading edge of a next sheet. As a mechanism that opens and closes the shutter between a sheet restricting position (a position protruding onto the sheet transportation path) and a non-restricting position (a position receded from the sheet transportation path) and fixes the shutter at each of the positions, a solenoid mechanism having a plunger and an electromagnetic coil is adopted.

The above-described moving mechanism of the shutter is formed of electrical components such as a solenoid. As a result, a number of components increases, and it is necessary to establish a complicated control sequence for synchronizing the moving mechanism of the shutter with another mechanism such as the pick-up roller. The cost of the components and the cost for designing and manufacturing are expensive. In addition, since it is necessary to secure a space for providing the mechanism including the solenoid or the like, it is difficult to downsize the device.

SUMMARY OF THE INVENTION

The present invention has been developed in view of the above-mentioned disadvantages. An advantage of the present invention is to provide a paper feeder and an image scanning device that can reduce the cost and the size by a simple structure and that can feed papers stably.

According to a first aspect of the present invention, the paper feeder includes a paper supplying unit, a separating unit, a transportation unit and a shutter. The paper supplying unit feeds sheets placed on a sheet placing part. The separating unit separates the sheets fed by the paper supplying unit one sheet at a time and supplies each sheet to a sheet transportation path. The transportation unit is provided downstream of the separating unit and transports the sheets. The shutter is provided in the sheet transportation path between the paper supplying unit and the separating unit. The shutter can open and close the sheet transportation path in response to a rotation direction of the transportation unit.

When the transportation unit is rotated in a forward direction, in other words, when papers are transported, the shutter recedes from the sheet transportation path in response to the forward rotation of the transportation unit. Therefore, the papers on the sheet transportation path are fed sequentially and transported to a target part (for example, a scanner) without being interfered with by the shutter. When the transportation unit is rotated in a backward direction or is stopped, the feeding and the transporting of the papers ends and the paper feeder is in a standby mode for supplying a next paper. At this time, the shutter protrudes onto an upper surface of the sheet transportation path in response to the backward rotation of the transportation unit. Therefore, a plural numbers of papers can be set with the leading edge of the papers aligned by the shutter. When the transportation unit starts rotating forward again, the shutter recedes from the sheet transportation path, and the papers in the sheet transportation path are fed and transported sequentially without delay.

According to a second aspect of the present invention, the paper feeder includes a paper supplying unit, a separating unit, a transporting unit, a shutter, an operation mechanism and a transmitting mechanism. The paper supplying unit feeds sheets placed on a sheet placing part. The separating unit separates the fed sheets one sheet at a time and supplies each sheet. The transportation unit is provided downstream of the separating unit. The shutter is provided to open and close the sheet transportation path between the paper supplying unit and the separating unit. The operation mechanism opens and closes the shutter in response to the rotation of the transportation unit. The transmitting mechanism transmits a rotation and a drive force to the paper supplying unit from a drive shaft of the separating unit. The transmitting mechanism includes a delay unit. When the shutter opens the sheet transportation path by the operation mechanism, the delay unit rotates the paper supplying unit after the opening movement is completed.

According to the above-described structure, in response to the rotation of the transportation unit, the shutter recedes from the sheet transportation path and is maintained under the receded state. Alternatively, in response to the rotation of the transportation unit, the shutter protrudes onto the sheet transportation path and is maintained under the protruded state. Therefore, when the shutter is under the receded state, the sheets are fed from the sheet placing part without delay. When the shutter is on standby, protruding to the sheet transportation path, a plural number of papers can be set on the sheet placing part with the leading edge of the papers aligned by the shutter. Then, when the shutter has completed receding, the pick-up roller starts rotating. Therefore, the leading edge of the fed paper is not caught by the shutter that is receding. As a result, a paper jam resulting from a paper being caught by the shutter is not generated.

BRIEF DESCRIPTION OF THE DRAWINGS

FIG. 7A is a perspective view of principal parts and FIG. 7B is a vertical cross-sectional view of the same.

FIG. 11A is a perspective view of principal parts and FIG. 11B is a vertical cross-sectional view of the same.

DETAILED DESCRIPTION OF THE PREFERRED EMBODIMENTS

First Embodiment

Figure 1:
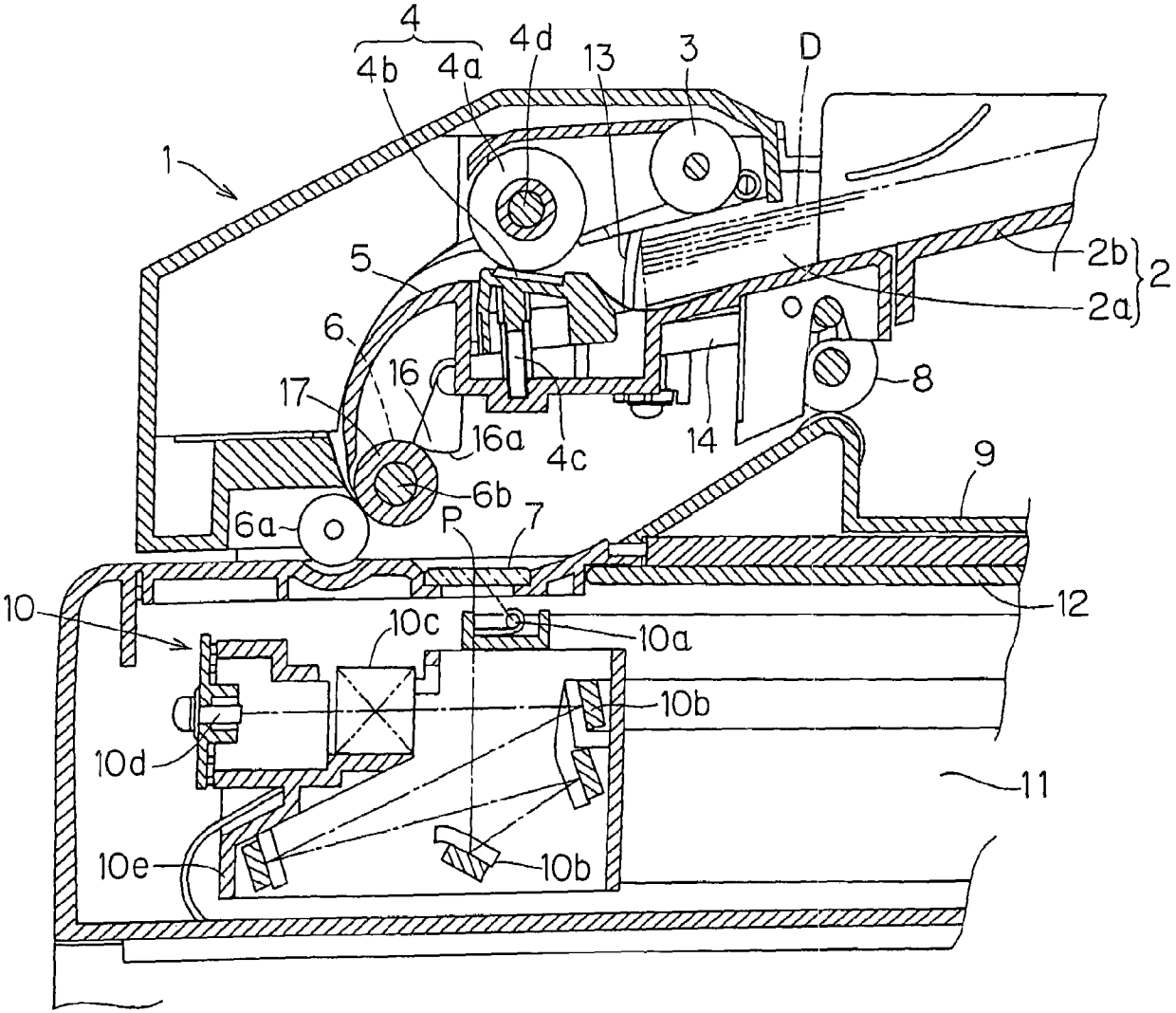
FIG. 1 is a vertical cross-sectional view showing principal parts of a scanner device of an ADF.

A first embodiment of the present invention will be described with reference to the accompanying drawings. FIG. 1 is a vertical cross-sectional view of the principal parts of an Automatic Document Feeder (ADF) 1 in a facsimile machine, a copying machine or a so-called multifunction peripheral having both a facsimile function and a copy function (also including a printer function). The ADF 1 forms an image scanning device. The image scanning device separates sheeted documents D one sheet at a time and sends each transported sheeted document to the scanner. The scanner scans image information of the document and converts the scanned image information into a digital signal. Then, the image scanning device outputs the digital signal to another device.

A document tray 2*b* is detachably attached to a document supply opening 2*a* of the ADF 1 in a manner that the document tray 2*b* is slanted downward towards the document supply opening 2*a*. The document supply opening 2*a* and the document tray 2*b* form a sheet placing part 2. A pick-up roller 3 is disposed above the document supply opening 2*a*. The pick-up roller 3 feeds the sheeted documents D stacked on the sheet placing part 2 from an uppermost sheet. A document separator 4 (separating unit) is also provided above the document supply opening 2*a*. Following the pick-up roller 3 (paper supplying unit), the document separator 4 separates the fed sheeted documents D one sheet at a time and supplies each sheeted document D.

The document separator 4 consists of a separate roller 4*a* and a separating pad 4*b*. The separating pad 4*b* is urged to make elastic contact with a peripheral body of the separate roller 4*a*. A sheeted document fed by the pick-up roller 3 is guided into between the separate roller 4*a* and the separate pad 4*b*. By a difference in friction coefficients to the paper of the separate roller 4*a* and the separate pad 4*b* accompanying a rotation of the separate roller 4*a*, the sheeted documents D are separated one sheet at a time and supplied to a downstream side. Reference numeral 4*c* denotes a compression spring that urges the separate pad 4*b* to make elastic contact with the peripheral body of the separate roller 4*a*.

Each of the sheeted documents, which have been separated one sheet at a time by the document separator 4, is transported through a curved paper transportation path 5 to a transportation roller 6 (transportation unit). The sheeted document is nipped by a pressure roller 6*a*, and transported to pass over a platen 7 and to be discharged onto a discharge tray 9 by a discharge roller 8. When the document passes over the platen 7, image information of the document is scanned sequentially by a scanner device 10 that is on standby below the platen 7. As described above, the scanned image information is output as a digital signal.

The scanner device 10 includes a light source 10*a* that is formed of a fluorescent light or a cold-cathode tube, a plurality of mirrors 10*b*, a lens 10*c* and a Charge Coupled Device (CCD) 10*d*. The light source 10*a*, the mirrors 10*b*, the lens 10*c* and the CCD 10*d* are unitized and loaded on a carriage 10*e*. An irradiating light from the light source 10*a* is reflected by the document that passes a scanning point P on the platen 7. The reflected right is reflected by four mirrors 10*b* and focused by the lens 10*c*, and an image is formed on the CCD 10*d* (refer to a light path shown with dashed lines). In the CCD 10*d*, image information of the document is converted into an electric signal and is output as a digital signal.

The scanner device 10 is also used for a Flat Bed Scanner (FBS). That is, although the drawing is partly abbreviated, a FBS 11 is disposed to a right side of a broken part of FIG. 1. In FIG. 1, the carriage 10*e* is under a standstill state at a scanning position of the sheeted document. When scanning the document by the FBS 11, the scanner device 10 moves into the FBS 11 and moves reciprocally in the FBS 11 along a lower surface of a platen glass 12. During the reciprocating movement, the image information of the document placed on the platen glass 12 is scanned by the scanner device 10. The ADF 1, the document tray 2*b* and the discharge tray 9 are unitized to form a platen cover. The platen cover can be opened and closed vertically with an inner part of the drawing in a depth direction as a hinge (not shown). Therefore, when scanning the document by the FBS 11, the platen cover is opened, the document is placed on the exposed platen glass 12, the platen cover is closed and the scanning process is carried out.

Figure 2:
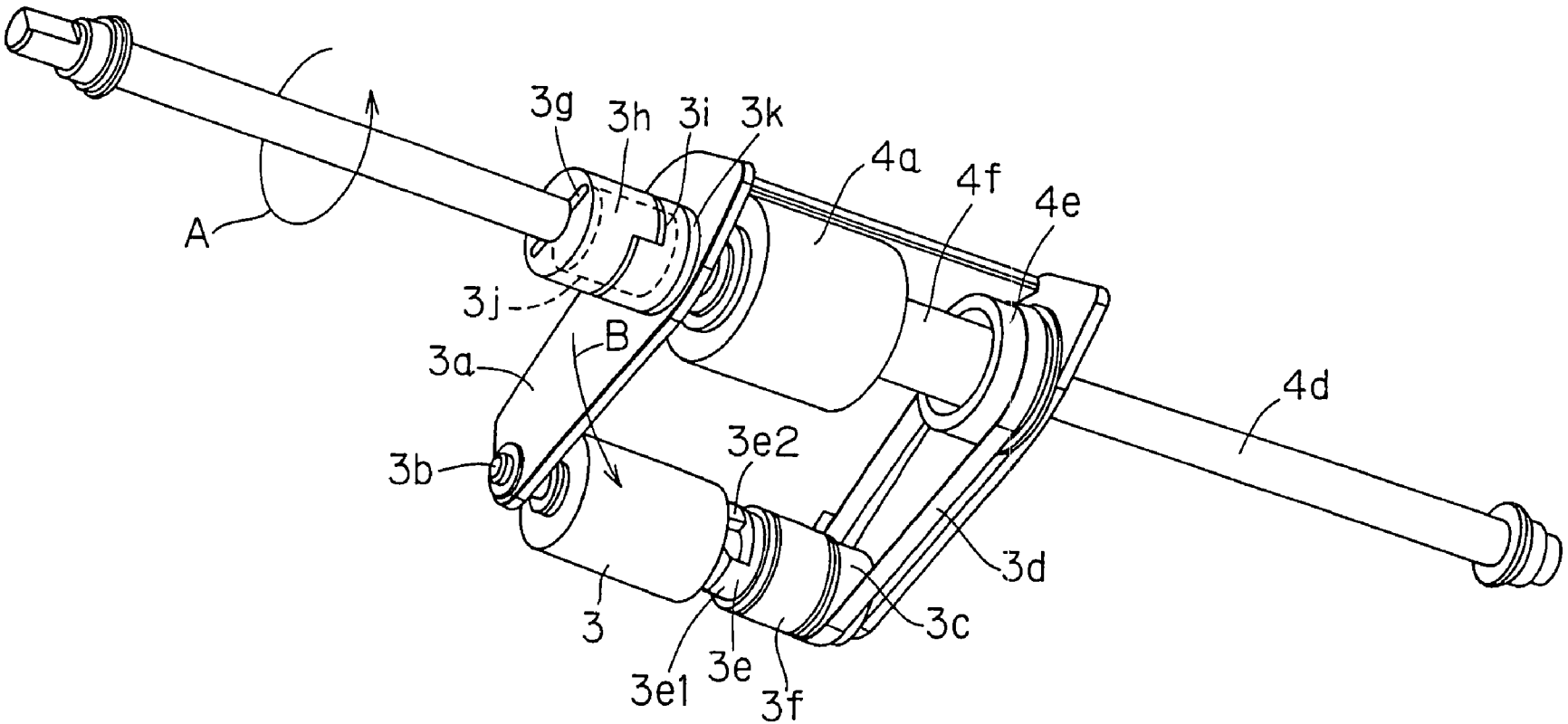
FIG. 2 is a perspective view of a drive mechanism of a unit of a pick-up roller and a separate roller when viewing the unit from below.
Figure 3:
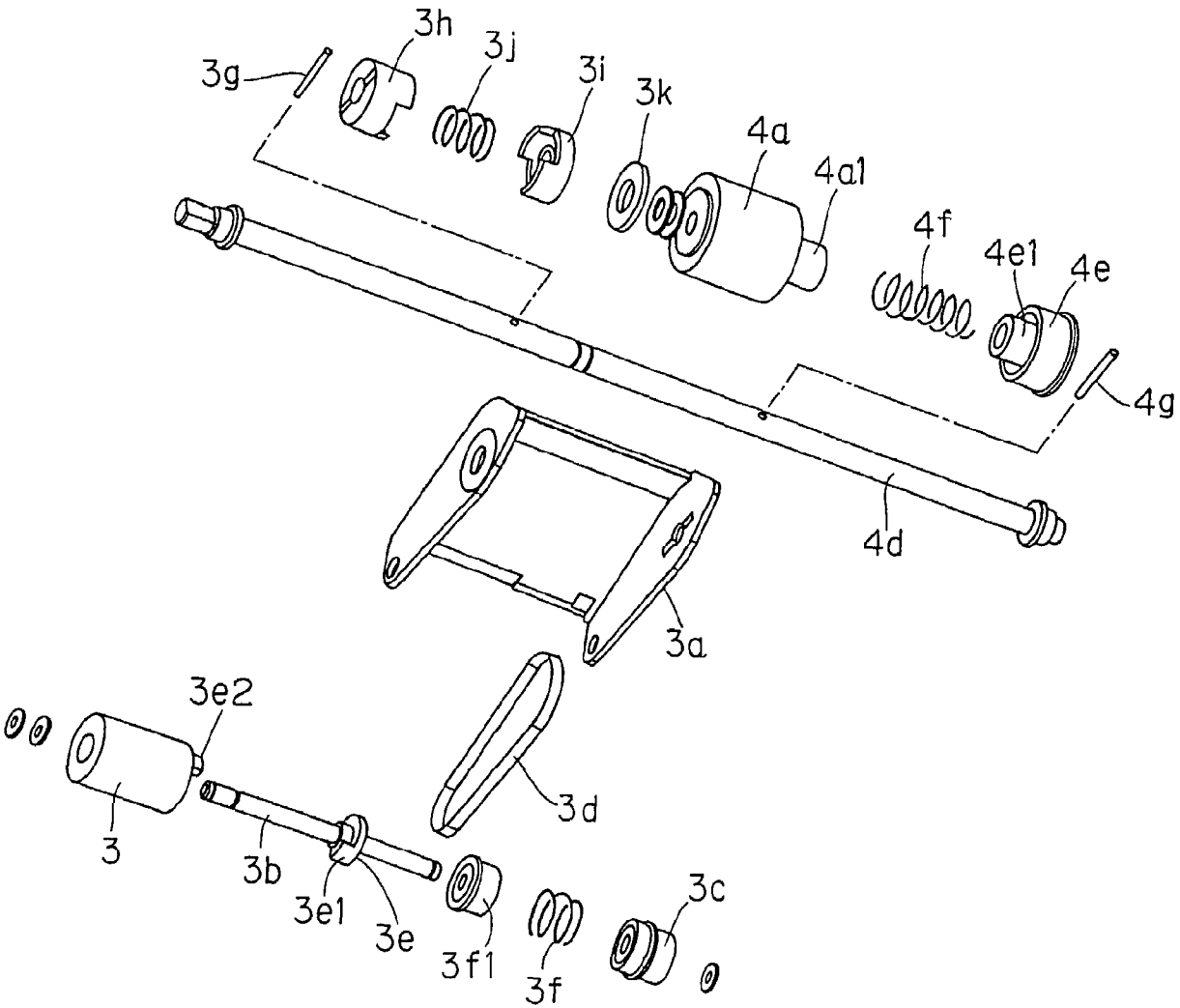
FIG. 3 is an exploded perspective view of the same.

The separate roller 4*a*, the transportation roller 6 and the discharge roller 8 have one motor (not shown) as a drive source. The drive force is transmitted appropriately via a transmitting unit (not shown) such as a gear or a belt. The drive force is transmitted to the pick-up roller 3 from a drive unit of the separate roller 4*a*. In the following, the transmission of the drive force to the pick-up roller 3 will be described. FIG. 2 is a perspective view of a drive mechanism of a unit of the pick-up roller 3 and the separate roller 4*a* when viewing the unit from below. FIG. 3 is an exploded perspective view of the same.

A drive shaft 4*d* of the separate roller 4*a* rotates by receiving a drive force of the motor. A pulley 4*e* is mounted on the drive shaft 4*d*. The pulley 4*e* rotates integrally with the drive shaft 4*d* via a delay unit to be described later. The separate roller 4*a* is mounted rotatably on the drive shaft 4*d*. A coil spring 4*f*, which couples the pulley 4*e* and the separate roller 4*a*, is fitted onto tubular members 4*e*1 and 4*a*1 of the pulley 4*e* and the separate roller 4*a*. The coil spring 4*f* functions as a clutch. The coil spring 4*f* is provided so that when the drive shaft 4*d* rotates in a forward direction (in a direction A in FIG. 2), the torque of the drive shaft 4*d* tightens the coil spring 4*f*. Therefore, when the drive shaft 4*d* rotates in a forward direction and the pulley 4*e* rotates integrally, the coil spring 4*f* is tightened and the tubular members 4*e*1 and 4*a*1 are tightly fit with one another via the coil spring 4*f*. As a result, the rotation of the pulley 4*e* is transmitted to the separate roller 4*a*, and the separate roller 4*a* rotates forward (in a direction to supply a document), in other words, rotates in the direction A.

The rotation of the pulley 4*e* is also transmitted to the pick-up roller 3. That is, a frame 3*a* is mounted on the drive shaft 4*d*. The frame 3*a* can swing vertically with the drive shaft 4*d* as a fulcrum. The pick-up roller 3 is fitted rotatably on a supporting shaft 3*b* which is supported rotatably on a tip end of the frame 3*a*. A pulley 3*c* is fitted rotatably on the supporting shaft 3*b*. A belt 3*d* is wound around the pulley 3*c* and the pulley 4*e* of the separate roller 4*a* in a tensioned state. The rotation of the pulley 4*e* of the separate roller 4*a* can be transmitted to the pulley 3*c* of the pick-up roller 3.

The rotation of the pulley 3*c* is transmitted to the pick-up roller 3 via a one-way clutch and a delay unit. That is, a one-way clutch 3*f*1 is fitted on the supporting shaft 3*b*. A coil spring 3*f* is mounted between the one-way clutch 3*f*1 and the pulley 3*c* to couple the one-way clutch 3*f*1 and the pulley 3*c*. The coil spring 3*f* is provided so that the forward rotation direction of the pulley 3*c*, in other words, the direction A (the document feeding direction) becomes a direction in which the coil spring 3*f* is loosened. When transmitting the drive force to the one-way clutch 3*f*1 by the rotation of the pulley 3*c* in the direction A, the coil spring 3*f* is not loosened and the drive force is transmitted by the tightening force of the coil spring 3*f*. Accordingly, when an abnormal load (for example, a force to pull the document in an opposite direction) is placed on the pick-up roller 3, the coil spring 3*f* is loosened to soften a shock applied to a drive transmitting system or the like of the pulley 3*c*. As a result, the drive transmitting system or the like of the pulley 3*d* is prevented from being worn out.

When the torque in the direction A shown in FIG. 2 works on the one-way clutch 3*f*1 via the coil spring 3*f*, the one-way clutch 3*f*1 is locked on the supporting shaft 3*b*. When the torque in a direction opposite to the direction A works on the one-way clutch 3*f*1, the one-way clutch 3*f*1 is unlocked. When the one-way clutch 3*f*1 is locked, the torque of the pulley 3*c* in the direction A is transmitted to the supporting shaft 3*b*. If a clutch can achieve the above-described functions, an existing clutch can be selected appropriately for the one-way clutch 3*f*1.

A delay unit 3*e* is mounted on the supporting shaft 3*b* in proximity to the one-way clutch 3*f*1. The delay unit 3*e* includes a clutch tab 3*e*1 that extends in a thrust direction. A clutch tab 3*e*2 protrudes from a side of the pick-up roller 3 in the thrust direction. When the clutch tabs 3*e*1 and 3*e*2 are engage with one another, the rotations of the delay unit 3*e* and the pick-up roller 3 are transmitted reciprocally. A function of the one-way clutch as a delay unit formed by the clutch tabs 3*e*1 and 3*e*2 will be described later.

The frame 3*a* swings vertically in response to the forward and the backward rotations of the drive shaft 4*d* via a torque limiter. A compression spring 3*j* (torque limiter) is elastically provided under a compressed state between a coupling member 3*h* and another coupling member 3*i*. The coupling member 3*h* is provided integrally on the drive shaft 4*d* via a pin 3*g* that is inserted penetrating through the drive shaft 4*d* in a direction perpendicular to an axial center of the drive shaft 4*d*. The coupling member 3*i* makes elastic contact with an outer surface of the frame 3*a*. When the drive shaft 4*d* rotates forward in the direction A, friction works between the coupling members 3*h* and 3*i* by a restoring elastic force of the compression spring 3*j*. Therefore, a force to swing the frame 3*a* in a direction B works on the frame 3*a*. As a result of the frame 3*a* swinging in the direction B, as shown in FIG. 1, the pick-up roller 2 makes contact against an uppermost layer of the sheeted documents D stacked on the document tray 2*b*.

When the drive shaft 4*d* continues to rotate forward even after the pick-up roller 3 makes contact against the uppermost layer of the sheeted documents D, the pick-up roller 3 is prevented from swinging by the stack of the sheeted documents D. However, the drive shaft 4*d* continues to rotate against the frictional force. Therefore, the rotation of the drive shaft 4*d* is transmitted to the pick-up roller 3 and the separate roller 4*a*. The sheeted documents D on the document tray 2*b* are fed from the uppermost layer and separated one sheet at a time. Then, each of the sheeted documents D is supplied towards the paper transportation path 5. Accompanying the feeding and the supplying of the sheeted documents D, the height of the sheeted documents D stacked on the document tray 2*b* becomes smaller. Since a force in the direction B is always working on the frame 3*a* while the drive shaft 4*d* is rotating in the direction A, the pick-up roller 3 is always pushed against the uppermost layer of the sheeted documents D, and the sheeted documents D are fed without delay.

When the feeding and the supplying of the sheeted documents D are completed (when there is no more sheeted document on the document tray 2*b*, in other words, when a sensor of the tray is switched off), the drive shaft 4*d* stops once. Then, when the drive shaft 4*d* rotates backward in the direction opposite to the direction A, a force in a direction opposite to the direction B works on the frame 3*a* by the friction of the compression spring 3*j*. As a result, a tip end of the frame 3*a* is held upward, and when the drive shaft 4*d* stops, the pick-up roller 3 is held at a standby position above the document tray 2*b*. Further, in the example shown in the drawings, a felt ring 3*k* is provided between the frame 3*a* and the coupling member 3*i*. The felt ring 3*k* functions to maintain an integration of the drive shaft 4*a* and the frame 3*a* accompanying the friction of the compression spring 3*j*. The felt ring 3*k* also functions to soften a frictional resistance resulting from the contact between the coupling member 3*i* and the frame 3*a* accompanying the rotation of the drive shaft 4*a* after the pick-up roller 3 makes contact with the stack of the documents and the swing of the pick-up roller 3 is restricted.

The sheeted documents D, which are fed by the pick-up roller 3 and separated one sheet at a time by the separate roller 4*a*, are transported to the transport roller 6 and resisted by the transportation roller 6. Then, each document is transported towards the scanning point P. A transportation peripheral speed of the transportation roller 6 is set slightly faster than peripheral speeds of the pick-up roller 3 and the separate roller 4*a*. This is for securing an interval between each page of the documents supplied continuously. Therefore, in relation to the length of the paper transportation path 5, when the leading edge of the sheeted document D reaches the transportation roller 6, a lower half of the sheeted document D is trapped by the separate roller 4*a* and the pick-up roller 3. Therefore, a transportation load (tensioning force) is placed on the sheeted document D due to the difference in the peripheral speeds. The tensioning force on the sheeted document D works in a direction to unlock the coil spring 4*f* and the one-way clutch 3*f*1 from the separate roller 4*a* and the pick-up roller 3 (in a direction to separate from the drive shaft 4*d* and the supporting shaft 3*b*). Therefore, the separate roller 4*a* and the pick-up roller 3 are shut from the respective drive transmitting system. The separate roller 4*a* and the pick-up roller 3 idle and the transportation load is reduced.

As described above, while the drive shaft 4*d* is rotating forward, the pick-up roller 3 is always pressed against the uppermost layer of the sheeted documents D. In addition, the drive transmitting system from the pulley 4*e* to the pulley 3*c* is always working. Therefore, when a lower edge of a previous document departs from the pick-up roller 3 and the tensioning force does not work on the pick-up roller 3, the transmission of the drive force from the pulley 3*c* to the pick-up roller 3 is restarted, and a next document is fed. In this case, after the effect of the tensioning force is dissolved, if the next document is fed immediately, the lower edge of the previous document and the leading edge of the next document are introduced to the separate roller 4 at the same time. However, the leading edge of the next document is prevented from entering the separate roller 4 by the separating action of the separate roller 4*a* and the separate pad 4*b*. Therefore, the leading edge part of the next document is curved between the separate roller 4*a* and the pick-up roller 3, and if the next document is supplied under a curved form, the document causes a paper jam.

To prevent the paper jam from occurring in advance, in the mechanism shown in the drawings, a differential clutch is provided between the one-way clutch 3*f*1 and the pick-up roller 3. The differential clutch consists of a tab 3*e*1 provided on the delay unit 3*e* and a tab 3*e*2 provided on the side of the pick-up roller 3. While the pick-up roller 3 is idling in the direction A under a state in which the pick-up roller 3 is pulled by the sheeted document D, the peripheral speed by the tensioning force is faster than the peripheral speed by the drive transmitting system. Therefore, although the tab 3*e*2 of the pick-up roller 3 is in contact with the tab 3*e*1 of the delay unit 3*e* from a back side in the rotation direction A, when the lower edge of the sheeted document D departs from the pick-up roller 3, the tensioning action is dissolved and the idling of the pick-up roller 3 stops.

Since the delay unit 3*e* continues to rotate in the direction A, the tab 3*e*1 of the delay unit 3*e* makes approximately one rotation and makes contact with the tab 3*e*2 of the pick-up roller 3 from a back side in the rotation direction A. When the tab 3*e*1 makes contact with the tab 3*e*2, the drive force can be transmitted from the delay unit 3*e* to the pick-up roller 3, and the pick-up roller 3 starts rotating in the direction A. Therefore, during a period from when the lower edge of the sheeted document D departs from the pick-up roller 3 until when the drive force becomes capable of being transmitted, the pick-up roller 3 stops. That is, during a period when the lower edge of the previous document departs from the pick-up roller 3 and passes through the separate roller 4*a*, the pick-up roller 3 stops and the next document is not fed. As a result, the lower edge of the previous document and the leading edge of the next document are not supplied at the same time, and the above-mentioned paper jam can be prevented.

As shown in FIG. 1, when the pick-up roller 3 is under a standby state, the shutter 13 is protruding on the sheet placing part 2. Therefore, when setting the sheeted documents D on the document tray 2*b* under this state, the leading edges of the sheeted documents D are aligned by the shutter 13. The shutter 13 recedes from the sheet placing part 2 when supplying the documents. When the supplying of the documents has been completed, the shutter 13 protrudes again onto the sheet placing part 2 and goes into the standby state. The movements of the shutter 13 to protrude onto the sheet placing part 2 and to recede from the sheet placing part 2 are carried out in response to the rotation of the transportation roller 6.

Figure 4:
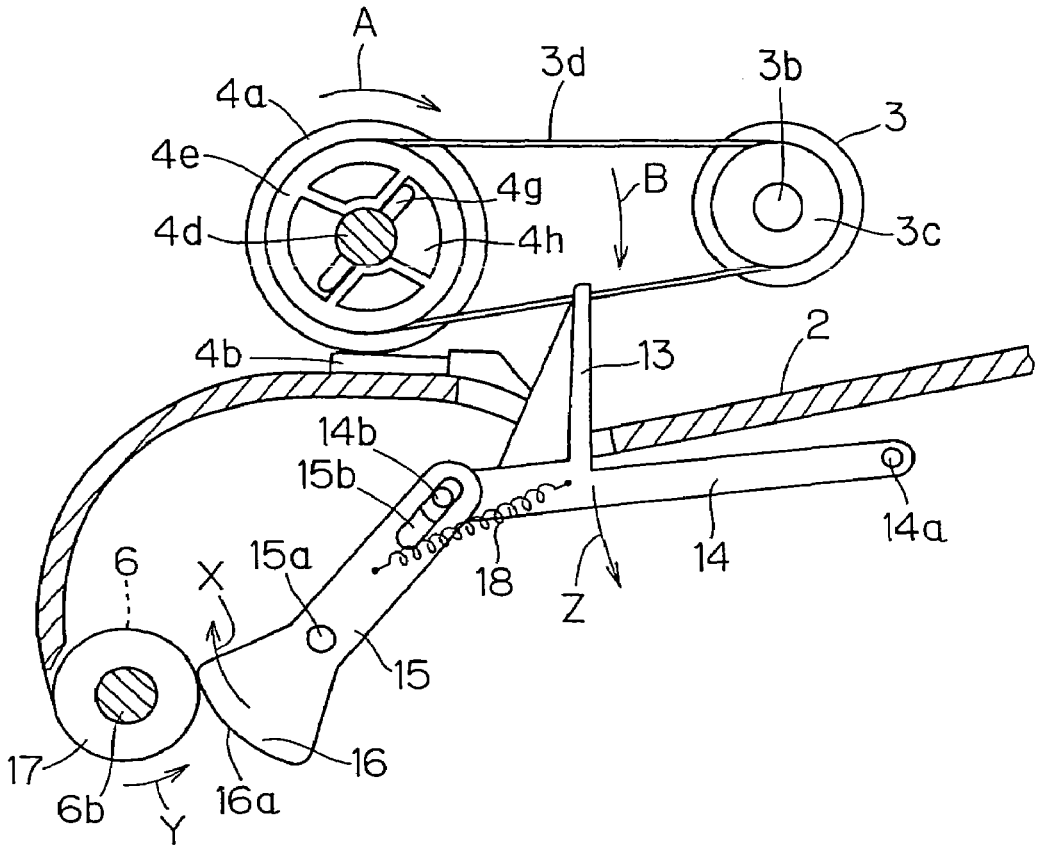
FIG. 4 shows a movement mechanism of a shutter.
Figure 5:
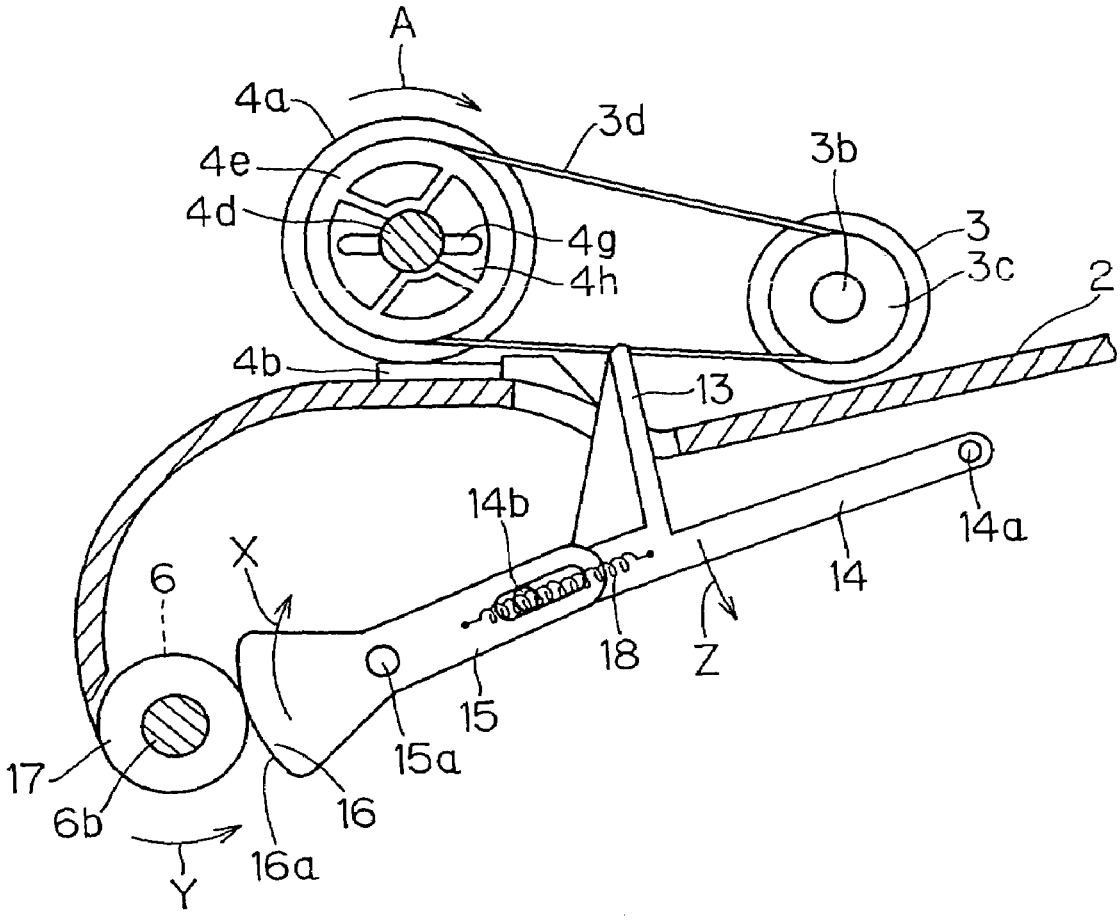
FIG. 5 shows a state in which the shutter has moved its position by the movement mechanism.
Figure 6:
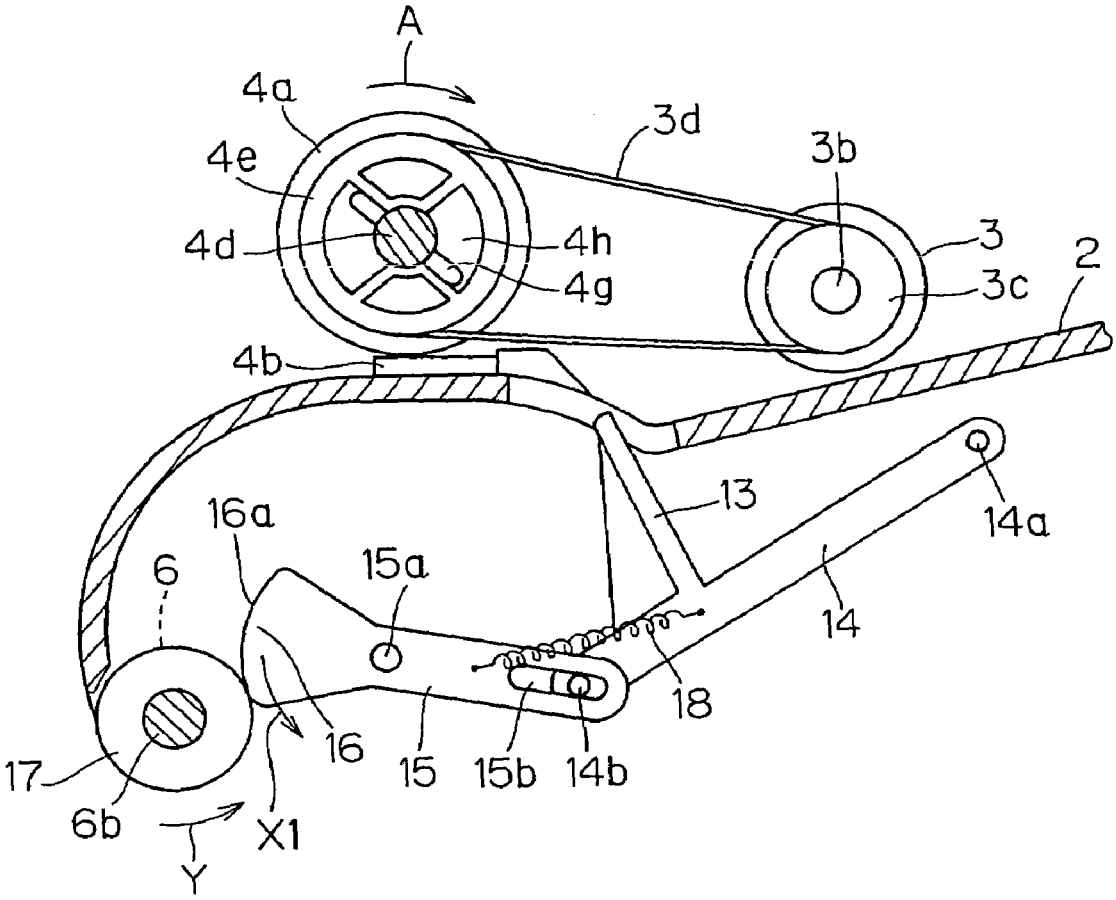
FIG. 6 shows a state in which the shutter has further moved its position by the movement mechanism.

Next, referring to FIG. 4 through FIG. 6, the movement of the shutter 13 will be described. FIG. 4 through FIG. 6 are schematic views showing a movement mechanism of the shutter 13. FIG. 4 shows a state in which the pick-up roller 3 is located at a standby position and the shutter 13 is protruded on the sheet placing part 2. FIG. 5 shows a state in which the pick-up roller 3 has descended and the shutter 13 is being stored into the receded position. FIG. 6 shows a state in which the shutter 13 is stored in the receded position and the document can be supplied.

In the drawings, the shutter 13 is formed integrally in an intermediate part of a first link 14 that swings vertically with a base end as a fulcrum 14*a*. One end of a second link 15 is connected to a swinging end of the first link 14 via a pin 14*b*. The second link 15 can rotate within a vertical surface area, with a fulcrum 15*a* as a center. Further, the fulcrum 15*a* is located at an intermediate part of the second link 15. A long hole 15*b* is formed along a longitudinal direction at a part where the second link 15 and the pin 14*b* are connected. Further, the long hole 15*b* enables the pin 14*b* to slide relatively. Another end of the second link 15 is fan-shaped and formed so that a center of a curvature of a circular arc 16 of the fan-shape corresponds with the fulcrum 15*a*. The circular arc 16 is formed by PolyOxyMethylene (POM) (known as an acetal).

A friction pulley (rotating body) 17 is mounted on a drive shaft 6*b* of the transportation roller 6 so that a circular arc surface 16*a* of the circular arc 16 makes frictional contact with a peripheral body of the friction pulley 17. For a material of the friction pulley 17, a material that improves the frictional contact between the friction pulley 17 and the circular arc surface 16*a* of the circular arc 16 is adopted. For example, the material of the friction pulley 17 may be urethane or elastomer. For a material of the transportation roller 6, a silicon rubber or an Ethylene Propylene-Diene terpolymer (EPDM) is adopted preferably. Further, in FIG. 1 and FIG. 4 through FIG. 6, the transportation roller 6 is hidden behind the friction pulley 17. A tension spring 18 is provided in a tensioned state between the first link 14 and the second link 15. In FIG. 4, the circular arc 16 is always urged elastically in a direction X by the tension spring 18. In other words, the circular arc 16 is in contact with the friction pulley 17 from the direction X.

The pulley 4*e* is mounted on the drive shaft 4*d* of the separate roller 4*a* so that the pulley 4*e* rotates integrally with the drive shaft 4*d*. As described above, the rotation of the pulley 4*e* is transmitted to the pick-up roller 3 via the belt 3*d* and the pulley 3*c* or the like. The pulley 4*e* and the drive shaft 4*d* are formed integrally by an engagement of a pin 4*g* and the pulley 4*e*. Further, the pin 4*g* is inserted penetrating through the drive shaft 4*d* in a direction perpendicular to the axial center of the drive shaft 4*d*. A wide-angled engaging space 4*h* is formed on an edge of the pulley 4*e* to provide play between the pin 4*g* and the pulley 4*e*. The engaging space 4*h* and the pin 4*g* form the above-described delay unit.

From the state shown in FIG. 4, when the drive shaft 4*d* of the separate roller 4*a* starts rotating in the direction A (the forward rotation), the transportation roller 6 and the friction pulley 17 also start rotating in a direction Y at the same time.

Since the circular arc 16 is always urged elastically in the direction X, accompanying the rotation of the friction pulley 17, the circular arc 16 and the friction pulley 17 make frictional contact immediately. The second link 15 rotates in the direction X with the fulcrum 15*a* as the center by the frictional contact. By the rotation of the second link 15, accompanying the sliding of the pin 14*b* in the long hole 15*b*, the first link 14 swings in a direction Z with the fulcrum 14*a* as the center. Accompanying the swing of the first link 14, the shutter 13 starts receding from the sheet placing part 2. FIG. 5 shows the receding process.

At the same time as when the drive shaft 4*d* starts rotating in the direction A, the pick-up roller 3 starts descending by the swing of the frame 3*a* in the direction B. The pick-up roller 3 stops descending when the pick-up roller 3 makes contact with the uppermost layer of the documents (not shown in FIGS. 4 through 6) placed on the sheet placing part 2. When the pick-up roller 3 makes contact with the uppermost layer of the documents, if the pick-up roller 3 is rotating, the documents are fed immediately. However, at this time, as shown in FIG. 5, the shutter 13 is still in the process of receding. Therefore, there are cases in which a fed document is caught by the shutter 13 and causes a paper jam. Thus, in the present embodiment, the rotation of the pick-up roller 3 is delayed by the delay units 4*g* and 4*h* so that the rotation of the pick-up roller 3 does not start immediately even when the pick-up roller 3 makes contact with the uppermost layer of the documents stacked on the sheet placing part 2.

That is, FIG. 4 shows a state in which the drive shaft 4*d* stops after rotating backwards in the direction opposite to the direction A in a previous stage. The pin 4*g* and the engaging space 4*h* are engaged at a side in the direction opposite to the direction A, and have play therebetween in the direction A. Therefore, even when the drive shaft 4*d* starts rotating in the direction A, the pin 4*g* and the engaging space 4*h* are not engaged immediately for there is play therebetween. As a result, the rotation of the drive shaft 4*d* is not transmitted to the pulley 4*e*. Thus, during this period of time, the pick-up roller 3 does not rotate, and until the shutter 13 is receded completely, the documents are not fed.

FIG. 6 shows a state in which the shutter 13 has receded completely from the sheet placing part 2 as a result of the transportation roller 6 continuing to rotate in the direction Y, the second link 15 rotating and the first link 14 swinging. Under this state, the pin 4*g* and the engaging space 4*h* are engaged in the direction A. The rotation of the drive shaft 4*d* in the direction A is transmitted to the pick-up roller 3 via the pulley 4*e*, the belt 3*d* and the pulley 3*c*. The documents are fed smoothly without being effected by the shutter 13.

The drive shaft 4*d* continues to rotate in the direction A. Accordingly, the documents stacked on the sheet placing part 2 are fed and supplied consecutively. The documents are further transported to the scanning point P by the transportation roller 6 and discharged onto the discharge tray 9.

During this period of time, the friction pulley 17 and the circular arc surface 16*a* of the circular arc 16 are disengaged from the frictional contacting state, and the shutter 13 is maintained under the receded state. Therefore, the feeding of the documents is not interfered with by the shutter 13. As a result of the rotation and the swing of the first link 14 and the second link 15, as shown in FIG. 6, the first link 14 and the second link 15 are bent to an opposite side when compared with the state shown in FIG. 4. As a result, the elastic urging force of the tension spring 18 with respect to the second link 15 is switched to a direction X1 as shown in FIG. 6. The friction pulley 17 continues to rotate in the direction Y. Therefore, due to an opposing relation of the direction X1 and the direction Y, although the friction pulley 17 and the circular arc surface 16*a* of the circular arc 16 are in contact with one another, the friction pulley 17 and the circular arc surface 16*a* do not make frictional contact and the shutter 13 is maintained under the receded state.

When all of the documents stacked on the sheet placing part 2 are supplied and the scanning of all of the documents has been completed, the motor (not shown) stops once and then rotates backward. By the backward rotation of the motor, the friction pulley 17 rotates in a direction opposite to the direction Y. Accompanying the backward rotation of the friction pulley 17, the friction pulley 17 and the circular arc surface 16*a* make frictional contact, and the second link 15 rotates in the direction X1. By receiving the rotation of the second link 15 in the direction X1, the first link 14 swings in a direction opposite to the direction Z, and the shutter 13 protrudes again onto the sheet placing part 2 as shown in FIG. 4. By the backward rotation of the motor, the drive shaft 4*d* of the separate roller 4*a* rotates in the direction opposite to the direction A. Accompanying the backward rotation of the drive shaft 4*d*, the frame 3*a* swings in the direction opposite to the direction B by the action of the compression spring (torque limiter) 3*j*. As a result, the pick-up roller 3 returns to the position shown in FIG. 4. Then, until there is an operation for supplying a next document, the standby state of FIG. 4 is maintained by the motor stopping.

As described above, the protruding and the receding movements of the shutter 13 with respect to the sheet placing part 2 are carried out by the vertical swing of the vertical swinging mechanism (the first link 14 and the second link 15) via the transmitting unit (the friction pulley 17 and the circular arc surface 16*a*) that moves in response to the rotation of the transportation roller 6. Therefore, it is not necessary to provide a solenoid and other expensive components that are incidental to the solenoid as in a conventional device. As a result, the cost of the device can be reduced. Moreover, by the action of the tension spring 18 that is provided in a tensioned state between the first link 14 and the second link 15, the friction pulley 17 and the circular arc surface 16*a* are transferred smoothly into frictional contacting state in each operational process. In addition, the protruding and the receding movements of the shutter 13 with respect to the sheet placing part 2 can be carried out accurately. Further, in the present embodiment, the friction pulley 17 that constitutes a part of the transmitting unit, in other words, the rotating body, has been described as being separate from the transportation roller 6. However, the circular arc surface 16*a* can be provided to make frictional contact with a part of the peripheral body of the transportation roller 6, and this part can also function as a rotating body of the transmitting unit.

Figure 7A:
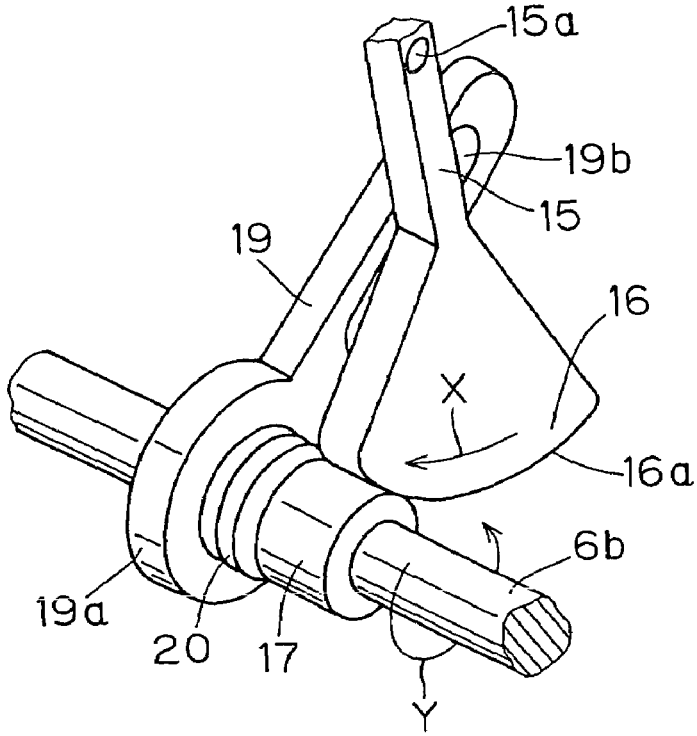
FIGS. 7A and 7B show another example of a unit that smoothly transfers a friction pulley and a circular arc surface to make a frictional contact in each movement process.
Figure 7B:
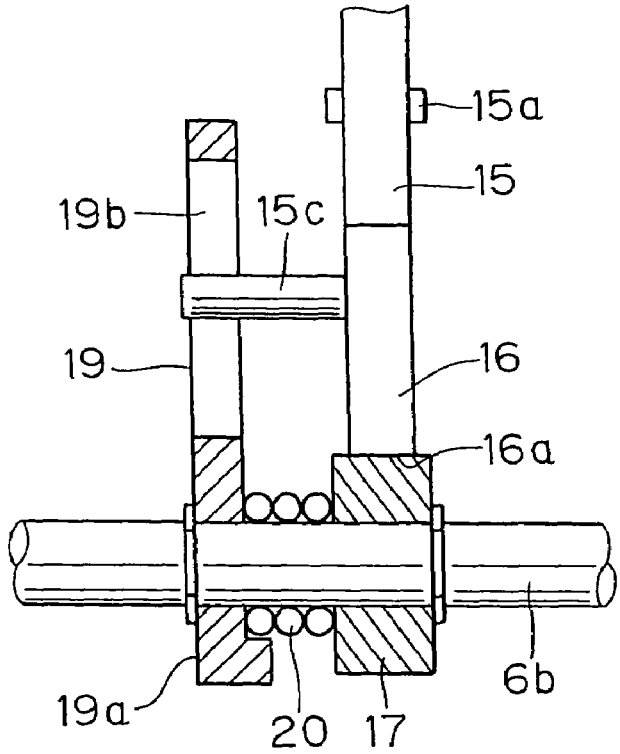

FIGS. 7A and 7B show another example of a unit that smoothly transfers the friction pulley 17 and the circular arc surface 16*a* to make frictional contact in each movement process, in place of the tension spring 18. FIG. 7A is a perspective view of principal parts and FIG. 7B is a vertical cross-sectional view of the same. A base part 19*a* of a restriction arm 19 is mounted on the drive shaft 6*b* of the transportation roller 6 in a manner that the base part 19*a* can rotate around the drive shaft 6*b*. Between the friction pulley 17 and the base part 19*a*, a compression spring 20 as a torque limiter is provided elastically under a compressed state. A long hole 19*b* is formed along a longitudinal direction of the restriction arm 19. A pin 15*c* protrudes from the second link 15 and is inserted slidable in the long hole 19*b*.

Under the above-described structure, for example, when the drive shaft 6*b* rotates in the direction Y (when the transportation roller 6 rotates forward), the circular arc 16 rotates in the direction X by the frictional contact between the circular arc 16 and the friction pulley 17. At this time, the restriction arm 19 rotates in the direction Y in response to the rotation of the drive shaft 6*b* by an action of the compression spring 20 as the torque limiter. During the rotation of the drive shaft 6*b* in the direction Y, the circular arc 16 is eventually displaced from the friction pulley 17 and the frictional contacting state is disengaged. However, the drive shaft 6*b* continues to rotate in the direction Y. The shutter 13 is maintained under the receded state as shown in FIG. 6 and the documents are supplied. During the rotation of the drive shaft 6*b* in the direction Y, the restriction arm 19 receives a restriction action of the pin 15*c* and the long hole 19*b* and maintained under a standstill state without rotating.

Then, when the drive shaft 6*b* stops rotating in the direction Y and starts rotating in the direction opposite to the direction Y, the restriction arm 19 rotates in the direction opposite to the direction Y by the action of the compression spring 20 as the torque limiter. When the restriction arm 19 attempts to rotate in the direction opposite to the direction Y, a force in a direction opposite to the direction X works on the circular arc 16 by the restriction action of the pin 15*c* and the long hole 19*b*. Then, the circular arc surface 16*a* is guided to make frictional contact with the peripheral body of the friction pulley 17. Therefore, the shutter 13 can be transferred smoothly into a protruded state. Further, in place of the compression spring 20, a wave washer can be provided elastically under a compressed state between the friction pulley 17 and the base part 19*a*. Alternatively, in place of the compression spring 20 or the wave washer, a friction member can be provided between the base part 19*a* and the drive shaft 6*b*.

Further, in the first embodiment, the description has been made of an example in the ADF. However, the present invention is not limited to this example. The present invention can be applied to a paper feeder for supplying a recording paper in various image forming devices. Moreover, the shutter 13 is provided to protrude onto the sheet placing table 2 from a lower direction. However, the shutter 13 can be provided to protrude from an upper direction. Furthermore, plural shutters 13 can be provided in a direction of the paper of FIG. 1. Alternatively, the friction pulley 17 and the circular arc 16 can be disposed at both sides of the transportation roller 6 in the axial direction of the transportation roller 6 and the drive force can be transmitted in a manner as described above. These features can be adopted randomly as a designing feature.

Therefore, when the transportation roller is rotating forward, in other words, when a sheet is transported, the shutter recedes from the sheet transportation path and is maintained under the receded state in response to the forward rotation of the transportation roller. Therefore, the sheet in the sheet transportation path is not interfered with by the shutter. The sheet can be fed sequentially without delay and transported to a target part (for example, a scanner).

When the transportation roller rotates backward and when the transportation roller stops, the feeding and the transporting of the sheet ends and it is on standby for supplying a next sheet. At this time, in response to the backward rotation of the transportation roller, the shutter protrudes onto an upper surface of the sheet transportation path and maintains the protruded state during a period when the transportation roller stops. Therefore, a plurality of sheets can be set with the leading edge of the sheets aligned by the shutter. Then, when the transportation roller starts rotating forward again, the shutter recedes from the sheet transportation path and maintains the receded state. The sheets are fed and transported sequentially without delay.

As described above, according to the forward rotation, the backward rotation and the stop of the transportation roller, by the swing of the vertical swinging mechanism via the transmitting unit, the shutter for aligning the leading edge of the sheets recedes from the sheet transportation path and maintains the receded state, and protrudes onto the sheet transportation path and maintains the protruded state. As a result, expensive electric components such as a solenoid are not required and the cost can be reduced. In addition, the cost for designing and manufacturing the operation sequence can also be reduced.

The transmitting unit consists of the rotating body, which is mounted on the drive shaft of the transportation roller, and the circular arc, which makes frictional contact with the peripheral body of the rotating body. Therefore, accompanying the forward and the backward rotations of the transportation roller, by using the frictional contact between the circular arc and the peripheral body of the rotating body, the second link rotates within the vertical surface area with the fulcrum located at the intermediate part of the second link as the center. Accompanying the rotation of the second link within the vertical surface area, the first link connected to one end of the second link by the pin swings vertically with the base end as a fulcrum. Therefore, by the vertical swing of the first link, the shutter protrudes to the sheet transportation path.

In this case, when the transportation roller continues to rotate forward or backward, the circular arc is displaced from the peripheral body of the rotating body. As a result, the transmission of the drive force by the frictional contact between the circular arc and the rotating body is shut. This state is a state in which the shutter is maintained at the receded position or at the protruded position. Therefore, when the transportation roller rotates forward, even after the circular arc is displaced from the peripheral body of the rotating body, if the transportation roller continues to rotate forward, the shutter is maintained at the receded position, and the sheet is fed smoothly without being interfered with by the shutter and transported to the target part. When the transportation roller rotates backward, after the circular arc is displaced from the peripheral body of the rotating body, the transportation roller stops. However, the shutter protrudes onto the sheet transportation path and is maintained under the protruded state. Therefore, when setting a next sheet on the sheet placing part, the leading edge of the sheet can be aligned by the protruded shutter.

As described above, when the transportation roller continues to rotate forward, or when the transportation roller continues to rotate backward and stops, the circular arc attempts to be displaced from the peripheral body of the rotating body. If a tension spring is provided in a tensioned state between the first link and the second link and the circular arc surface of the circular arc is urged to contact elastically with the peripheral body of the rotating body at all times from the peripheral direction by the tension spring, even after the transportation roller rotates backward and stops, the circular arc surface is urged to contact elastically with the peripheral body of the rotating body from the peripheral direction. Therefore, when rotating the transportation roller forward later on, the circular arc surface of the circular arc and the peripheral body of the rotating body make frictional contact again. The torque of the transportation roller is transmitted to the second link via the circular arc surface. Then, as described above, the shutter recedes from the sheet transportation path.

While the transportation roller continues to rotate forward, the torque of the rotating body works on the circular arc as a force to be displaced from the rotating body. However, the circular arc is urged against the peripheral body of the rotational body to resist against the force of the rotating body. Therefore, when stopping the transportation roller once and then rotating backward later on, the circular arc surface of the circular arc and the peripheral body of the rotating body make frictional contact again. The torque of the transportation roller rotating backward is transmitted to the second link via the circular arc surface. Then, as described above, the shutter protrudes onto the sheet transportation path.

In response to the rotation of the transportation roller, the shutter recedes from the sheet transportation path and maintains the receded state. Alternatively, the shutter protrudes onto the upper surface of the sheet transportation path and maintains the protruded state. Therefore, when the shutter is under the receded state, the sheets are fed without delay. When the shutter is on standby under the protruded state, a plural numbers of sheets can be set with the leading edge aligned. After the receding of the shutter has been completed, the pick-up roller starts rotating. Therefore, the leading edge of the fed sheet is not caught by the shutter that is receding. As a result, a paper jam resulting from a sheet being caught by the shutter does not generate.

As described above, the protruding and the receding movements of the shutter for aligning the leading edge of the sheets are carried out by the mechanism that moves in response to the rotation of the transportation roller. Therefore, expensive electric components such as a solenoid become unnecessary and the cost of the components can be reduced. In addition, the cost for designing and manufacturing the operation sequence becomes unnecessary. Furthermore, it is not necessary to consider the above-described paper jam, and the device is extremely practical to use.

Second Embodiment

Figure 8:
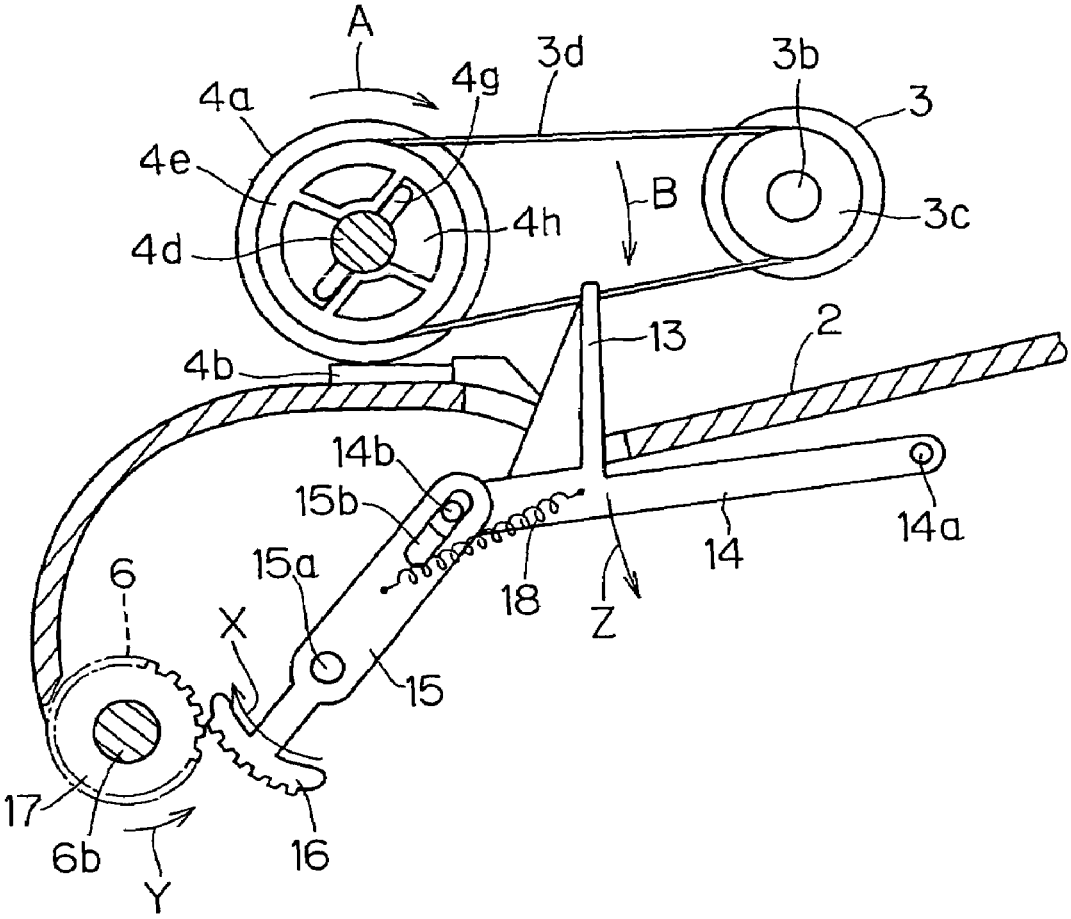
FIG. 8 shows a movement mechanism of a shutter according to another embodiment of the present invention.
Figure 9:
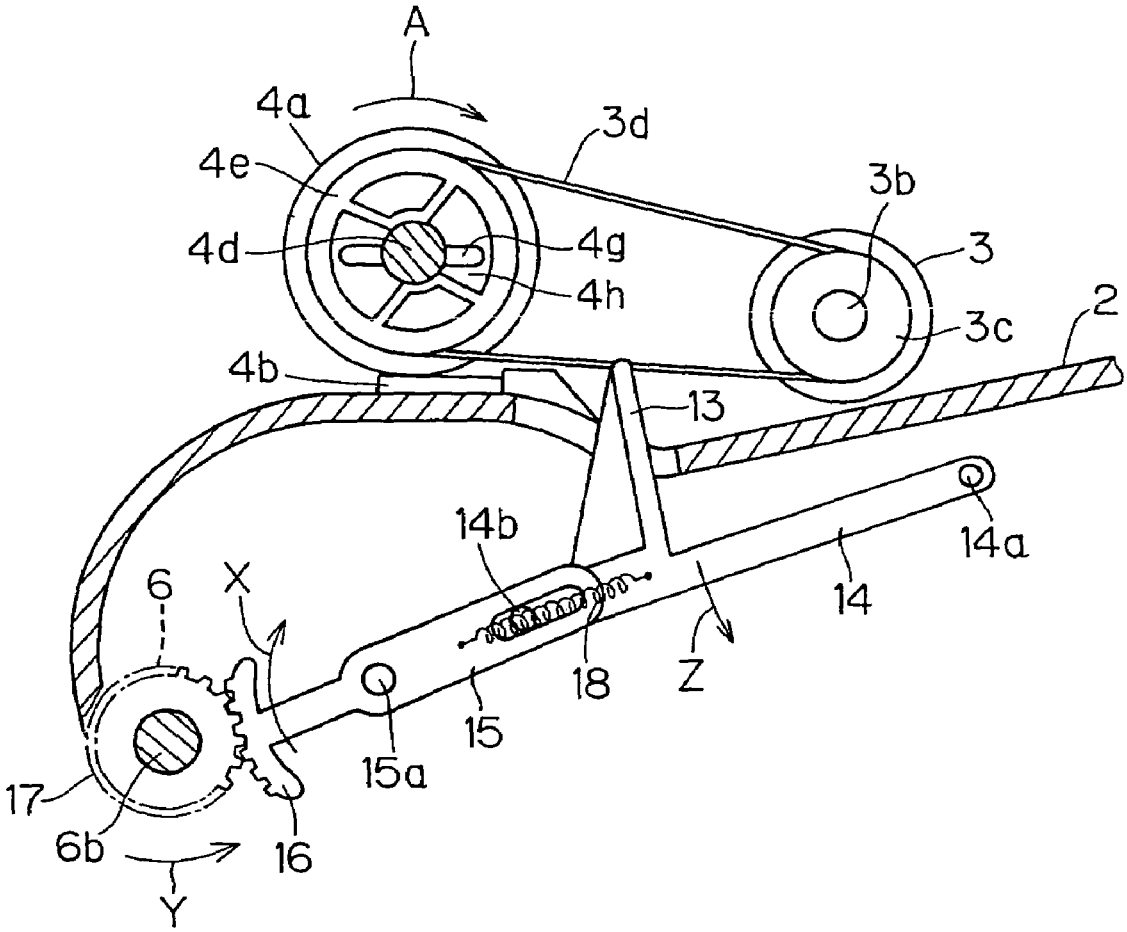
FIG. 9 shows a state is which the shutter has moved its position by the movement mechanism.
Figure 10:
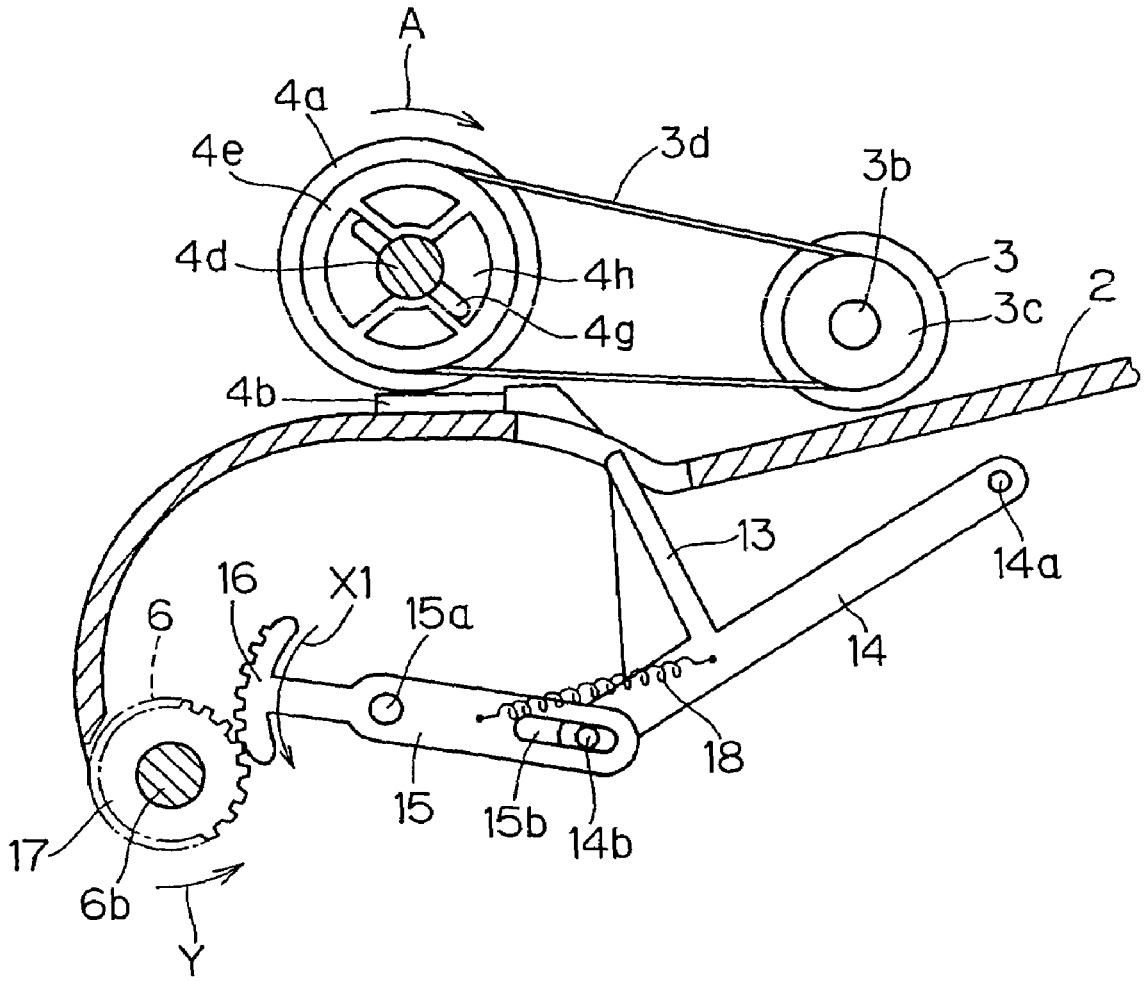
FIG. 10 shows a state in which the shutter has further moved its position by the movement mechanism.

In addition to the embodiment shown in FIG. 1 through FIG. 7, the transmitting unit can be applied to another embodiment shown in FIG. 8 through FIG. 10.

The description of parts that overlap with the first embodiment will be omitted, and an operation of a second embodiment will be described in detail. FIG. 8 through FIG. 10 are schematic views showing a movement mechanism of the shutter 13 according to the second embodiment of the present invention. FIG. 8 shows a state in which the pick-up roller 3 is located at the standby position and the shutter 13 protrudes onto the sheet placing part 2. FIG. 9 shows a state in which the pick-up roller 3 has descended and the shutter 13 is being stored into the receded position. FIG. 10 shows a state in which the shutter 13 is stored in the receded position and the document can be supplied. In the drawings, the shutter 13 is formed integrally in the intermediate part of the first link 14 that swings vertically with the base end as the fulcrum 14*a*. One end of the second link 15 is connected to the swinging end of the first link 14 via the pin 14*b*. The second link 15 can rotate within the vertical surface area with the fulcrum 15*a* as the center. Further, the fulcrum 15*a* is located at the intermediate part of the second link 15. The long hole 15*b* is formed on the second link 15 along a longitudinal direction at the part where the second link 15 and the pin 14*b* are connected. Further, the long hole 15*b* enables the pin 14*b* to slide relatively. A circular arc gear 16*b* is formed on another end of the second link 15. The circular arc gear 16*b* is formed so that a center of the curvature of the circular arc gear 16*b* corresponds with the fulcrum 15*a*.

A gear 17 is mounted on the drive shaft 6*b* of the transportation roller 6. The gear 17 is provided to be engaged with the circular arc gear 16*b*. Further, in FIG. 1 and FIG. 8 through FIG. 10, the transportation roller 6 is hidden behind the gear 17. The tension spring 18 is provided in a tensioned state between the first link 14 and the second link 15. In FIG. 8, the circular arc gear 16*b* is always urged elastically in the direction X by the tension spring 18. In other words, the circular arc gear 16*b* is in contact with the gear 17 from the direction X.

The pulley 4*e* is mounted on the drive shaft 4*d* of the separate roller 4*a* so that the pulley 4*e* rotates integrally with the drive shaft 4*d*. As described above, the rotation of the pulley 4*e* is transmitted to the pick-up roller 3 via the belt 3*d* and the pulley 3*c* or the like. The pulley 4*e* and the drive shaft 4*d* are formed integrally by an engagement of the pin 4*g* and the pulley 4*e*. The pin 4*g* is inserted penetrating through the drive shaft 4*d* in a direction perpendicular to the axial center of the drive shaft 4*d*. A wide-angled engaging space 4*h* is formed on the edge of the pulley 4*e* to provide play for the engagement between the pin 4*g* and the pulley 4*e*. The engaging space 4*h* and the pin 4*g* form the above-described delay unit.

From the state shown in FIG. 8, when the drive shaft 4*d* of the separate roller 4*a* starts rotating in the direction A (forward rotation), the transportation roller 6 and the gear 17 also start rotating in the direction Y at the same time. Since the circular arc gear 16*b* is always urged elastically in the direction X, accompanying the rotation of the gear 17, the gear 17 and the circular arc gear 16*b* are engaged immediately. The second link 15 rotates in the direction X with the fulcrum 15*a* as the center by the engagement. By the rotation of the second link 15, accompanying the sliding of the pin 14*b* in the long hole 15*b*, the first link 14 swings in the direction Z with the fulcrum 14*a* as the center. Accompanying the swing of the first link 14, the shutter 13 starts receding from the sheet placing part 2. FIG. 9 shows the receding process.

At the same time the drive shaft 4*d* starts rotating in the direction A, the pick-up roller 3 starts descending by the swing of the frame 3*a* in the direction B. The pick-up roller 3 stops descending when the pick-up roller 3 makes contact with the uppermost layer of the sheeted documents (not shown in FIG. 8 through FIG. 10) placed on the sheet placing part 2. When the pick-up roller 3 makes contact with the uppermost layer of the documents, if the pick-up roller 3 is rotating, the documents are fed immediately. However, at this time, as shown in FIG. 9, the shutter 13 is sill in the process of receding. Therefore, there are cases in which the fed document is caught by the shutter 13 and causes a paper jam. Therefore, in the present embodiment, the rotation of the pick-up roller 3 is delayed by the delay units 4*g* and 4*h* so that the rotation of the pick-up roller 3 does not start immediately even when the pick-up roller 3 makes contact with the uppermost layer of the documents stacked on the sheet placing part 2.

That is, FIG. 8 shows a state in which the drive shaft 4*d* has stopped after rotating backward in the direction opposite to the direction A in a previous stage. The pin 4*g* and the engaging space 4*h* are engaged at a side in the direction opposite to the direction A and have play therebetween in the direction A. Therefore, even when the drive shaft 4*d* starts rotating in the direction A, the pin 4*g* and the engaging space 4*h* are not engaged immediately for there is play therebetween. As a result, the rotation of the drive shaft 4*d* is not transmitted to the pulley 4*e*. Thus, during this period of time, the pick-up roller 3 does not rotate, and until the shutter 13 has receded completely, the documents are not fed.

FIG. 10 shows a state in which the shutter 13 has receded completely from the sheet placing part 2 as a result of the transportation roller 6 continuing to rotate in the direction Y, the second link 15 rotating and the first link 14 swinging. Under this state, the pin 4*g* and the engaging space 4*h* are engaged in the direction A. The rotation of the drive shaft 4*d* in the direction A is transmitted to the pick-up roller 3 via the pulley 4*e*, the belt 3*d* and the pulley 3*c*. The documents are fed smoothly without being interrupted by the shutter 13. By continuing the rotation of the drive shaft 4*d* in the direction A, the documents stacked on the sheet placing part 2 are fed and supplied consecutively. The documents are transported to the scanning point P by the transportation roller 6 and discharged onto the discharge tray 9.

During this period, the gear 17 and the circular arc gear 16*b* are disengaged, and the shutter 13 is maintained under the receded state. Therefore, the supplying of the documents is not interfered with by the shutter 13. As a result of the rotation and the swing of the first link 14 and the second link 15, as shown in FIG. 10, the first link 14 and the second link 15 are bent to an opposite side when compared with the state shown in FIG. 4. As a result, the elastic urging force of the tension spring 18 with respect to the second link 15 is switched to the direction X1 as shown in FIG. 6. The gear 17 continues to rotate in the direction Y. Therefore, due to the opposing relation of the direction X1 and the direction Y, although the gear 17 and the circular arc gear 16*b* are in contact with one another, the gear 17 and the circular arc gear 16*b* are not engaged and the shutter 13 is maintained under the receded state.

Then, when all of the documents stacked on the sheet placing part 2 are supplied and scanning has been completed, the motor (not shown) is stopped once and then rotates backward. By the backward rotation of the motor, the gear 17 rotates in the direction opposite to the direction Y. Accompanying the rotation of the gear 17, the gear 17 and the circular arc gear 16*b* are engaged and the second link 15 rotates in the direction X1. By receiving the rotation of the second link 15 in the direction X1, the first link 14 swings in the direction opposite to the direction Z, and the shutter 13 protrudes again onto the sheet placing part 2 as shown in FIG. 8. By the backward rotation of the motor, the drive shaft 4*d* of the separate roller 4*a* rotates in the direction opposite to the direction A. Accompanying the backward rotation of the drive shaft 4*d*, the frame 3*a* swings in the direction opposite to the direction B by the action of the compression spring (torque limiter) 3*j*. As a result, the pick-up roller 3 returns to the position shown in FIG. 8. Then, until there is an operation for supplying a next document, the standby state of FIG. 8 is maintained by the stop of the motor.

As described above, the protruding and the receding movements of the shutter 13 with respect to the sheet transportation path are carried out by the vertical swing of the vertical swinging mechanism (the first link 14 and the second link 15) via the transmitting unit (the engagement of the gear 17 and the circular arc gear 16*b*) that moves in response to the rotation of the transportation roller 6. Therefore, it is not necessary to provide a solenoid and other expensive components that are incidental to the solenoid as in a conventional device. As a result, the cost of the device can be reduced. Moreover, by the action of the tension spring 18 that is provided in a tensioned state between the first link 14 and the second link 15, the gear 17 and the circular arc gear 16*b* are transferred smoothly into an engaged state in each operational process. In addition, the protruding and the receding movements of the shutter 13 with respect to the sheet placing part 2 can be carried out accurately.

Figure 11A:
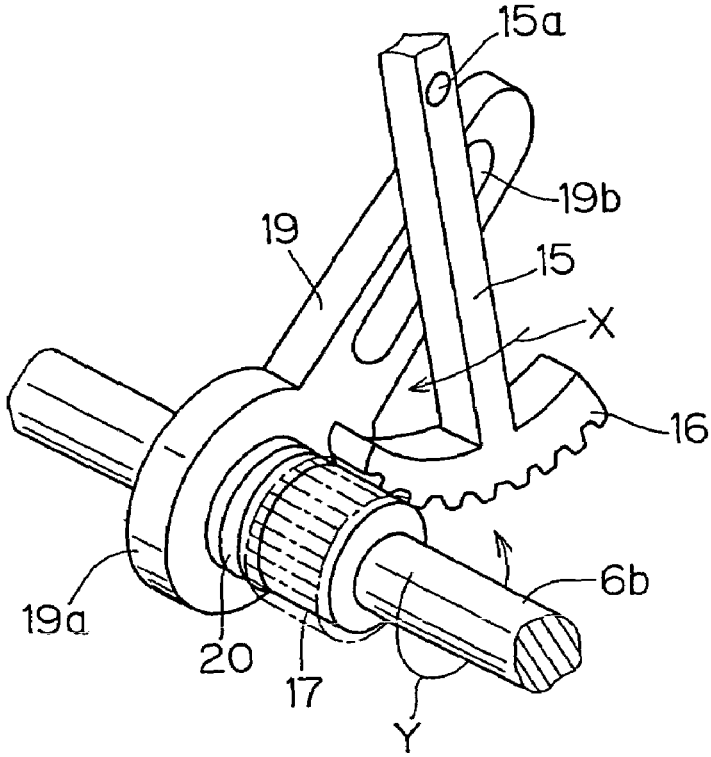
FIGS. 11A and 11B show another example of a unit that smoothly transfers a gear and a circular arc gear into an engaged state in each movement process.
Figure 11B:
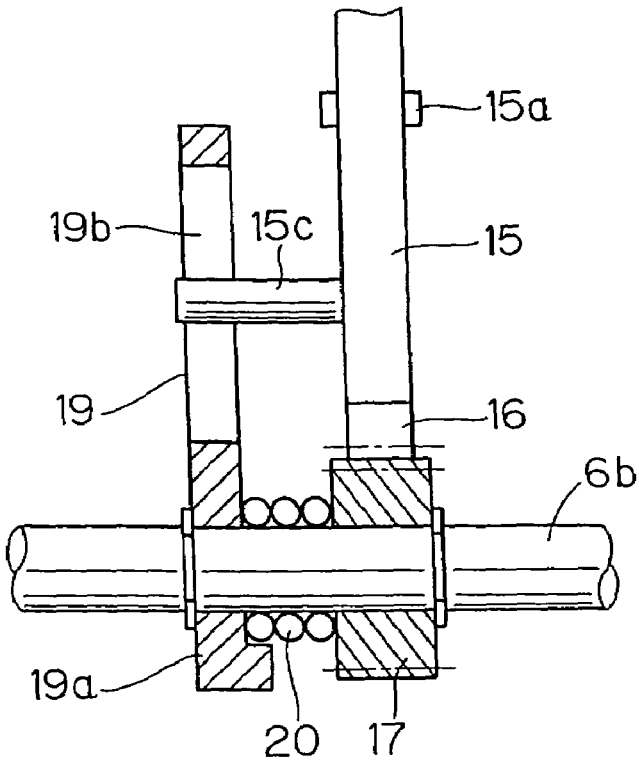

FIGS. 11A and 11B show another example of a unit that smoothly transfers the gear 17 and the circular arc gear 16*b* into an engaged state in each movement process, in place of the tension spring 18. FIG. 11A is a perspective view of principal parts and FIG. 11B is a vertical cross-sectional view of the same. The base part 19*a* of the restriction arm 19 is mounted on the drive shaft 6*b* of the transportation roller 6 in a manner that the base part 19*a* can rotate around the drive shaft 6*b*. Between the gear 17 and the base part 19*a*, the compression spring 20 as the torque limiter is provided elastically under a compressed state. The long hole 19*b* is formed along the longitudinal direction on the restriction arm 19. The pin 15*c* protrudes from the second link 15 and inserted slidable in the long hole 19*b*.

Under the above-described structure, for example, when the drive shaft 6*b* rotates in the direction Y (when the transportation roller 6 rotates forward), the circular arc gear 16*b* rotates in the direction X by the engagement between the gear 17 and the circular arc gear 16*b*. At this time, the restriction arm 19 rotates in the direction Y in response to the drive shaft 6*b* by the action of the compression spring 20 as the torque limiter. During the rotation of the drive shaft 6*b* in the direction Y, the circular arc gear 16*b* is eventually displaced from the gear 17 and the circular arc gear 16*b* and the gear 17 are disengaged. However, the drive shaft 6*b* continues to rotate in the direction Y. The shutter 13 is maintained under the receded state as shown in FIG. 10 and the documents are supplied. During the rotation of the drive shaft 6*b* in the direction Y, the restriction arm 19 receives the restriction action of the pin 15*c* and the long hole 19*b* and is maintained under a standstill state without rotating.

Then, when the drive shaft 6*b* stops rotating in the direction Y and starts rotating in the direction opposite to the direction Y, the restriction arm 19 rotates in the direction opposite to the direction Y by the action of the compression spring 20 as the torque limiter. When the restriction arm 19 attempts to rotate in the direction opposite to the direction Y, a force in the direction opposite to the direction Y works on the circular arc gear 16*b* by the restriction action of the pin 15*c* and the long hole 19*b*. Then, the circular arc gear 16*b* is guided to be engaged with the gear 17. Therefore, the shutter 13 can be transferred smoothly into the protruded state.

Further, in place of the compression spring 20, a wave washer can be provided elastically under a compressed state between the gear 17 and the base part 19*a*. Alternatively, in place of the compression spring 20 or the wave washer, a friction member can be provided between the base part 19*a* and the drive shaft 6*b*.

In the second embodiment, the description has been made of an example in the ADF. However, the present invention is not limited to this example. The present invention can be applied to a paper feeder for supplying recording paper in various image forming devices. Moreover, the shutter 13 is provided to protrude onto the sheet placing table 2 from a lower direction. However, the shutter 13 can be provided to protrude from an upper direction. Furthermore, a plurality of shutters 13 can be provided in the direction of the paper of FIG. 1. Alternatively, the gear 17 and the circular arc gear 16*b* can be disposed on both sides of the transportation roller 6 in the axial direction of the transportation roller 6 and the drive force can be transmitted in a manner as described above. These features can be adopted randomly as design features.

According to the forward rotation, the backward rotation and the stopping of the transportation roller, the vertical swinging mechanism is swung via the transmitting unit by the engagement of the gear. In addition, the shutter for aligning the leading edge of the sheets recedes from the sheet transportation path and maintains the receded state, and protrudes onto the sheet transportation path and maintains the protruded state. As a result, expensive electric components such as a solenoid are not required and the cost can be reduced. In addition, the cost for designing and manufacturing the operation sequence can also be reduced. Since the transmitting unit uses the engagement of the gear, changes over time such as a decrease in the function resulting from abrasion becomes difficult to generate.

What is claimed is:

1. A paper feeder comprising:

means for supplying that feeds sheets placed on a sheet placing part;

means for separating the sheets fed by the means for supplying one sheet at a time and supplying each sheet to a sheet transportation path;

means for transporting the sheets provided downstream of the means for separating;

means for transmitting a drive force from the means for separating to the means for supplying; and a link mechanism connected to the means for transporting via the means for transmitting, wherein when the means for transporting rotates in a sheet transporting direction, the link mechanism swings so that a shutter recedes and opens the sheet transportation path and maintains an opened state, and when the means for transporting rotates in a direction opposite to the sheet transporting direction, the link mechanism swings so that the shutter protrudes and closes the sheet transportation path, wherein the shutter is provided to the link mechanism, and provided at the sheet transportation path between the means for supplying and the means for separating.

2. The paper feeder according to claim 1, wherein the link mechanism includes a first link which swings vertically with a base end as a fulcrum and a second link having one end connected to a swinging end of the first link by a pin and the second link rotates within a vertical surface area with a fulcrum located at an intermediate part of the second link as a center; and wherein the shutter is attached to an intermediate part of the first link, wherein the means for transmitting includes a rotating body mounted on a drive shaft of the means for transporting, and wherein the fulcrum of the second link is at a center of a curvature of a circular arc and a circular arc surface of the circular arc makes frictional contact with a peripheral body of the rotating body.

3. The paper feeder according to claim 2, wherein an elastic body is provided between the first link and the second link, and the circular arc surface is urged by the elastic body so that the circular arc surface always makes electrical contact with the peripheral body of the rotating body from a circumferential direction.

4. The paper feeder according to claim 3, wherein the elastic body is a tension spring.

5. The paper feeder according to claim 1, wherein the means for transmitting operates by an engagement with a gear provided on the means for transporting, and when the means for transporting rotates in a forward direction, the link mechanism swings via the means for transmitting and the means for transmitting opens the shutter from the sheet transportation path and maintains the opened state, and when the means for transporting rotates in a backward direction, the link mechanism swings via the means for transmitting and the means for transmitting closes the sheet transportation path by the shutter and maintains a closed state while the means for transporting is stopped.

6. The paper feeder according to claim 5, wherein the link mechanism includes a first link which swings vertically with a base end as a fulcrum and a second link having one end connected to a swinging end of the first link by a pin and which rotates within a vertical surface area with a fulcrum located at an intermediate part of the second link as a center; and wherein the shutter is attached to an intermediate part of the first link, wherein the means for transmitting includes a gear mounted on a drive shaft of the means for transporting, and wherein the fulcrum of the second link is at a center of a curvature of a circular arc gear and the gear and the circular arc gear are engaged when transmitting a drive force.

7. The paper feeder according to claim 6, wherein an elastic body is provided between the first link and the second link, and the circular arc gear is always urged by the elastic body in a direction engaged with the gear.

8. The paper feeder according to claim 7, wherein the elastic body is a tension spring.

9. A paper feeder comprising:

means for supplying that feeds sheets placed on a sheet placing part;

means for separating the sheets fed one sheet at a time and supplying each sheet;

means for transporting provided downstream of the means for separating;

a shutter protruding and receding in a sheet transportation path between the means for supplying and the means for separating;

an operation mechanism that protrudes and recedes the shutter in response to a rotation of the means for transporting; and a transmitting mechanism that transmits a command for a rotation and a drive from a drive shaft of the means for separating to the means for supplying, wherein the transmitting mechanism includes a means for delaying, and when receding the shutter from the sheet transportation path by the operation mechanism, the means for delaying delays a rotation of the means for supplying and rotates the means for supplying after the shutter has completed receding.

10. The paper feeder according to claim 9, wherein the transmitting mechanism includes a rotating member located at the means for separating mounted on the drive shaft of the means for separating, a rotating member located at the means for supplying mounted on a supporting shaft of the means for supplying, and a transmitting member provided between the rotating members; and the means for delaying includes a pin penetrating through the drive shaft in a direction perpendicular to the drive shaft, and an engaging space formed on the rotating member located at the means for separating and engages with the pin by permitting a rotation of the rotating member located at the means for separating within a prescribed angular range with respect to the drive shaft.

11. The paper feeder according to claim 9, wherein the operation mechanism includes a vertical swinging mechanism connected to the means for transporting via the transmitting mechanism, and when the means for transporting rotates in a forward direction, the vertical swinging mechanism swings via the means for transmitting and the operation mechanism recedes the shutter from the sheet transportation path and maintains a receded state, and when the means for transporting rotates in a backward direction, the vertical swinging mechanism swings via the transmitting mechanism and the operation mechanism protrudes the shutter to the sheet transportation path and maintains a protruded state while the means for transporting is stopped, and a rotation of a drive shaft of the means for transporting and a rotation of the drive shaft of the means for separating are coupled.

12. The paper feeder according to claim 10, wherein the operation mechanism includes a vertical swinging mechanism connected to the means for transporting via the transmitting mechanism, and when the means for transporting rotates in a forward direction, the vertical swinging mechanism swings via the transmitting mechanism and the operation mechanism recedes the shutter from the sheet transportation path and maintains a receded state, and when the means for transporting rotates in a backward direction, the vertical swinging mechanism swings via the transmitting mechanism and the operation mechanism protrudes the shutter to the sheet transportation path and maintains a protruded state while the means for transporting is stopped, and a rotation of a drive shaft of the means for transporting and a rotation of the drive shaft of the means for separating are coupled.

13. An image scanning device comprising:

means for supplying that feeds sheets placed on a sheet placing part;

means for separating the sheets fed by the means for supplying one sheet at a time and supplying each sheet to a sheet transportation path;

means for transporting the sheets provided downstream of the means for separating;

means for transmitting a drive force from the means for separating to the means for supplying; and a link mechanism connected to the means for transporting via the means for transmitting, wherein when the means for transporting rotates in a sheet transporting direction, the link mechanism swings so that a shutter recedes and opens the sheet transportation path and maintains an opened state, and when the means for transporting rotates in a direction opposite to the sheet transporting direction, the link mechanism swings so that the shutter protrudes and closes the sheet transportation path, wherein the shutter is provided to the link mechanism, and provided at the sheet transportation path between the means for supplying and the means for separating.

14. The image scanning device according to claim 13, wherein the link mechanism includes a first link which swings vertically with a base end as a fulcrum and a second link having one end connected to a swinging end of the first link by a pin and the second link rotates within a vertical surface area with a fulcrum located at an intermediate part of the second link as a center; and wherein the shutter is attached to an intermediate part of the first link, wherein the means for transmitting includes a rotating body mounted on a drive shaft of the means for transporting, and wherein the fulcrum of the second link is at a center of a curvature of a circular arc and a circular arc surface of the circular arc makes frictional contact with a peripheral body of the rotating body.

15. The image scanning device according to claim 14, wherein an elastic body is provided between the first link and the second link, and the circular arc surface is urged by the elastic body so that the circular arc surface always makes electrical contact with the peripheral body of the rotating body from a circumferential direction.

16. The image scanning device according to claim 13, wherein the means for transmitting operates by an engagement with a gear provided on the means for transporting, and when the means for transporting rotates in a forward direction, the link mechanism swings via the means for transmitting and the means for transmitting opens the shutter from the sheet transportation path and maintains the opened state, and when the means for transporting rotates in a backward direction, the link mechanism swings via the means for transmitting and the means for transmitting closes the sheet transportation path by the shutter and maintains a closed state while the means for transporting is stopped.

17. The image scanning device according to claim 16, wherein the link mechanism includes a first link which swings vertically with a base end as a fulcrum and a second link having one end connected to a swinging end of the first link by a pin and the second link rotates within a vertical surface area with a fulcrum located at an intermediate part of the second link as a center; and wherein the shutter is attached to an intermediate part of the first link, wherein the means for transmitting includes a gear mounted on a drive shaft of the means for transporting, and wherein the fulcrum of the second link is at a center of a curvature of a circular arc gear and the gear and the circular arc gear are engaged when transmitting a drive force.

18. The image scanning device according to claim 17, wherein an elastic body is provided between the first link and the second link, and the circular arc gear is always urged by the elastic body in a direction engaged with the gear.

19. A paper feeder comprising:

a sheet supply unit that feeds sheets placed on a sheet placing part;

a separating roller that separates the sheets fed by the sheet supply unit one sheet at a time and supplies each sheet to a sheet transportation path;

a transportation roller that transports the sheets provided downstream of the separating roller; and a link mechanism connected to the transportation roller via a transmitting unit, wherein when the transportation roller rotates in a sheet transporting direction, the link mechanism swings so that a shutter opens the sheet transportation path and maintains an opened state, and when the transportation roller rotates in a direction opposite to the sheet transporting direction, the link mechanism swings so that the shutter closes the sheet transportation path.

20. The paper feeder according to claim 19, wherein the shutter protrudes the sheet transportation path when closed and recedes from the sheet transportation path when opened with respect to the sheet transportation path in response to a rotation direction of the transportation roller.

* * * * *